United States Patent [19]

Duchesneau

[11] Patent Number: 4,778,127

[45] Date of Patent: Oct. 18, 1988

[54] MISSILE FIN DEPLOYMENT DEVICE

[75] Inventor: Jerome G. Duchesneau, Andover, Conn.

[73] Assignee: United Technologies Corporation, Hartford, Conn.

[21] Appl. No.: 902,984

[22] Filed: Sep. 2, 1986

[51] Int. Cl.[4] ..... F42B 13/32

[52] U.S. Cl. ..... 244/3.29; 188/284; 188/298; 188/314; 188/297

[58] Field of Search ..... 244/3.26–3.3; 188/284, 287, 298, 314, 297; 267/34

[56] References Cited

U.S. PATENT DOCUMENTS

| | | | |
|---|---|---|---|
| 3,125,956 | 3/1964 | Kongelbeck | 102/50 |
| 3,189,133 | 6/1965 | Dillenburger | 188/298 |
| 3,563,495 | 2/1971 | Korn | 244/3.29 |
| 3,697,019 | 10/1972 | Watson | 244/3.29 |
| 3,853,288 | 12/1974 | Bode | 244/3.29 |
| 4,143,838 | 3/1979 | Holladay | 244/3.28 |
| 4,175,720 | 11/1979 | Craig | 244/3.28 |
| 4,284,177 | 8/1981 | Domek | 188/287 |
| 4,296,895 | 10/1981 | Pazmany | 244/3.29 |
| 4,358,983 | 11/1982 | Fallon et al. | 89/1.806 |
| 4,509,427 | 4/1985 | Andreoli | 102/261 |
| 4,510,846 | 4/1985 | Gazzera | 91/460 |
| 4,575,025 | 3/1986 | Sadvary et al. | 244/3.27 |

*Primary Examiner*—Deborah L. Kyle
*Assistant Examiner*—Michael J. Carone
*Attorney, Agent, or Firm*—Lloyd D. Doigan

[57] ABSTRACT

A missile (10) and concepts for deploying the fins (14) thereof from a stored to a deployed position are disclosed. One device described has three main portions including: A first end portion (32) housing an initiator (22) that powers the device and a locking mechanism (26) that holds the fin at its stored and its locked position; a central portion (34) housing a driven piston (24) that rotates a positively connected fin (14) from the stored to the deployed position; and, a second end portion (36) housing a damping system that controls the rate of deployment of the fins.

17 Claims, 3 Drawing Sheets

MISSILE FIN DEPLOYMENT DEVICE

TECHNICAL FIELD

This invention relates generally to finned missiles and particularly to concepts for deploying the fins thereof.

BACKGROUND ART

Missiles have fins to provide directional control and aerodynamic stability during flight. Prior to missile use, the fins are typically folded in a stored position about the missile body to conserve storage space and to minimize handling and launching problems. The fins are rotated from the stored to a deployed position either prior to the placement of a missile on a launching device, after the missile is fired from a launching tube, or after the missile is dropped from an aircraft and reaches a given altitude or a predetermined time passes. It is particularly important that the fins be deployed quickly without damaging vehicle components and remain in the deployed position to provide stable flight characteristics to the missile.

Prior art deployment devices generally rely on spring or pneumatic pressure, the force of the missile exhaust, or the rotational force of the fired missile to deploy the fins. U.S. Pat. Nos. 3,125,956 to Kongelbeck entitled "Foldable Fin"; 3,697,019 to Watson entitled "Stablizing Fin Assembly"; 3,853,288 to Bode entitled "Encasement for the Tail Section of a Rocket with a Central Nozzle and Extendible Control Vanes"; 4,143,838 to Holladay entitled "Folding Fin Assembly Detent"; 4,175,720 to Craig entitled "Retainer/Release Mechanism for Use on Fin Stabilized Gun Fired Projectiles"; 4,296,895 to Pazmany entitled "Fin Erection Mechanism"; 4,358,983 to Fallon et al., entitled "Blast Enabled Missile Detent/Release Mechanism"; 4,509,427 to Andreoli entitled "Tail Fin Firing Device"; and, 4,510,846 to Gazzera entitled "Pneumatic Actuator Device" are representative of typical fin deployment mechanisms.

Other techniques for deploying the fins of a missile are sought, and it is to this end that the present invention is directed.

DISCLOSURE OF THE INVENTION

According to the invention, a powered hinge deploys a missile fin from a stored position by applying an explosive force to the fin and then absorbing that force to decelerate the fin in a controlled manner as the fin approaches a deployed position.

A feature of the invention is a high pressure initiator that provides an explosive force to quickly deploy the fin.

Another feature of the invention is a piston, having a connection with the fin within the hinge, that reacts to the explosive force to deploy the fin through the connection therewith.

A further feature of the invention is a fluid filled damping cylinder that receives the piston as it reacts to the explosive force to decelerate the piston (and concomitantly, the connected fin) as the fin approaches the deployed position.

An additional feature is a locking mechanism that holds the piston securely to lock the connected fin in the stored and in the deployed positions, but that releases the piston and the fin from the stored position upon the application of the explosive force to allow the fin to travel to the deployed position.

A principal advantage of the invention is the expedited deployment of the missile fin while minimizing the risk of damage to missile components such as fins or locking mechanisms. The explosive charge accelerates the fin towards its deployed position very quickly while the cylinder absorbs the force of the charge to decelerate the fin as it approaches the deployed position thereby avoiding damage to missile components. Since the fins are deployed quickly with minimal risk of damage and are securely held at the deployed position, the missile has a higher probability of achieving stable flight characteristics.

Other features and advantages of the present invention will become more apparent in light of the following detailed description of the best mode for carrying out the invention and in the accompanying drawings.

BEST MODE FOR CARRYING OUT THE INVENTION

Figure 1:
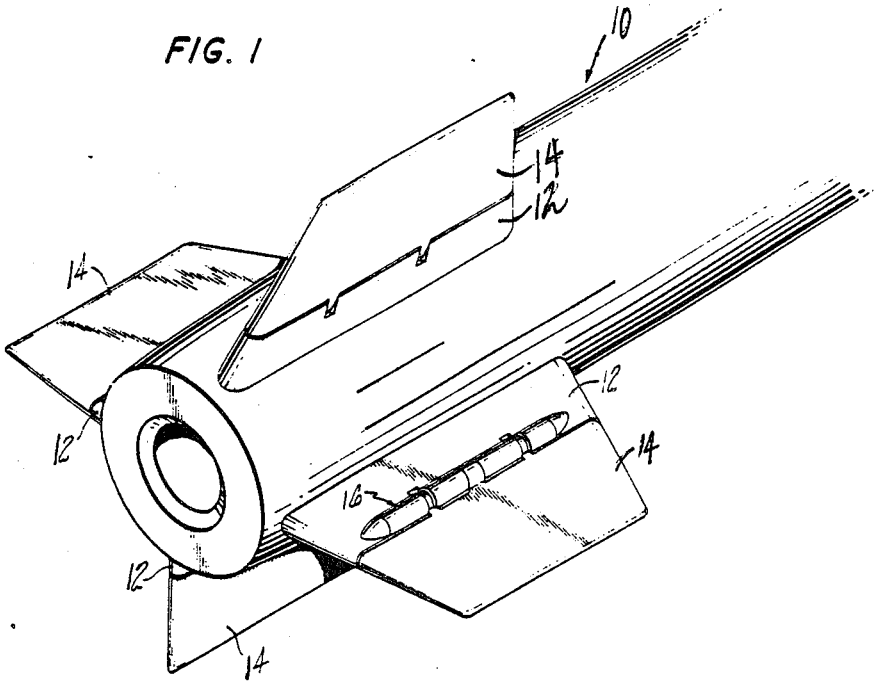
FIG. 1 is a partial prospective view of the missile fin deployment device of this invention connecting a fin in its deployed position to a missile fairing.

An aft portion of a missile employing the concepts of the present invention is illustrated FIG. 1. The missile 10 has a plurality of fairings 12 extending radially therefrom in alignment with the longitudinal axis of the missile. A fin 14 is connected to each fairing by a deployment device, such as a powered hinge 16. Each hinge is capable of deploying the fin associated therewith from a stored position (as shown in FIG. 2) to a deployed position (as shown in FIG. 1).

Figure 2:
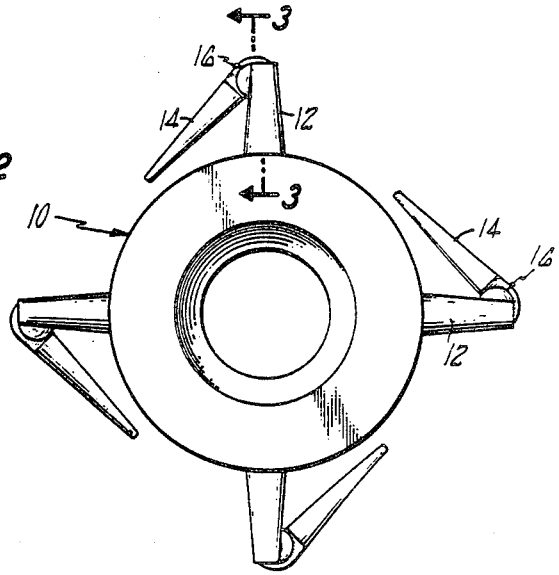
FIG. 2 is an end view of the missile fin deployment device of FIG. 1 showing the missile fins in the stored position.
Figure 3:
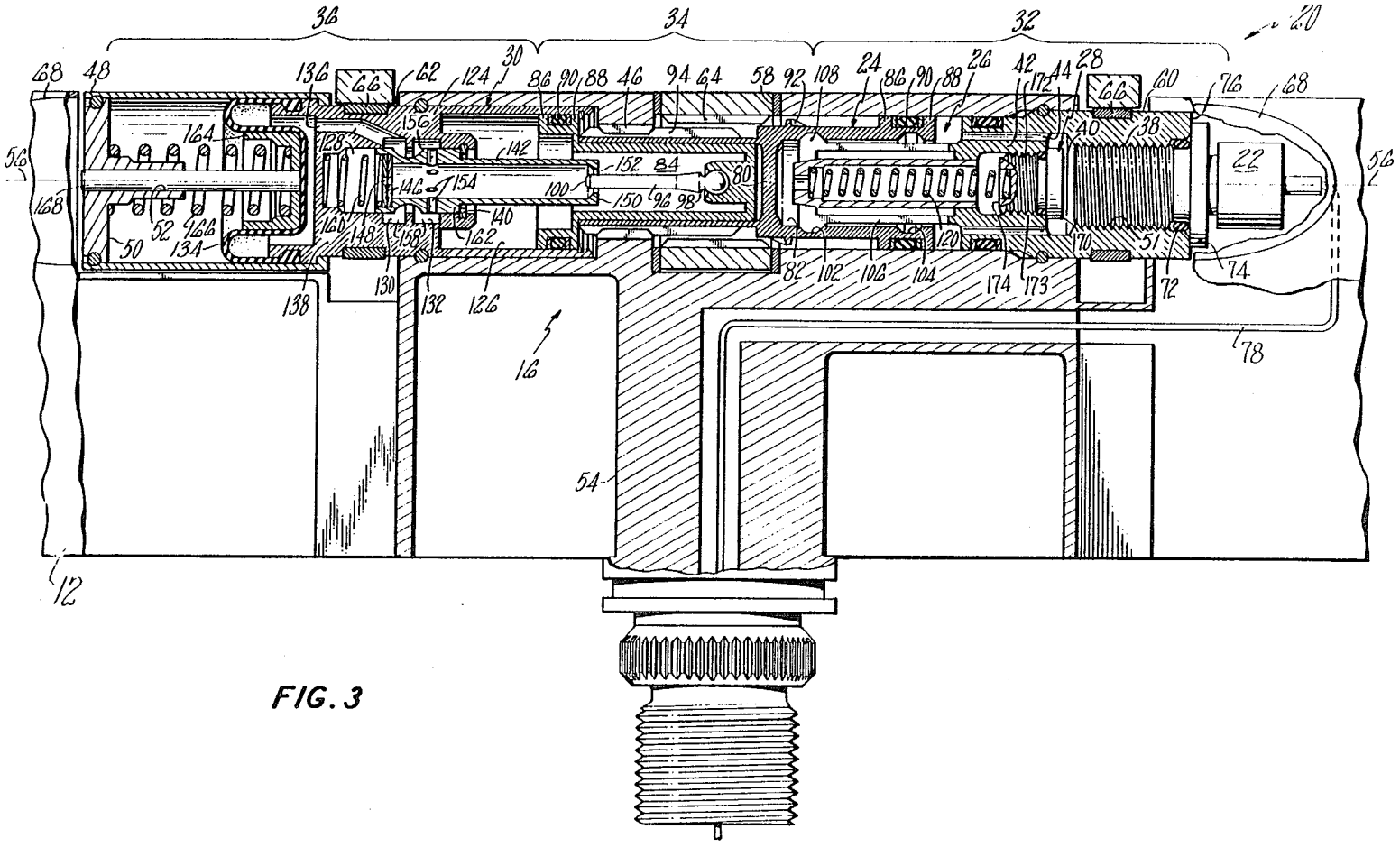
FIG. 3 is a cross-sectional view of the deployment device of the invention, taken along the line 3—3 of FIG. 2.

FIG. 3 shows the details of the hinge 16 taken along the line 3—3 of FIG. 2. The major hinge components include: a roughly cylindrical housing 20 which connects the fin 14 to the fairing 12 through the housing's exterior surface, an initiator 22 which is capable of generating a high pressure gas, a piston 24 that is driven axially by the pressurized gas and is positively connected to the fin such that the axial movement of the piston is translated to rotational force to deploy the fin, a locking mechanism 26 which locks the piston and the positively connected fin at its stored and deployed positions, a mechanical access plug 28, and a fluid-filled damping system 30 which controls the rate of the fin rotation by decelerating the axial motion of the piston.

THE HOUSING

Referring to FIG. 3, the housing 20 in one detailed embodiment is a compact steel cylinder having a low aerodynamic profile, having a diameter of three and three tenths centimeters (3.3 cm) and a length of approximately twenty and three tenths (20.3) centimeters for a typical application. The housing has three major interior portions. A first end portion 32 encloses the initiator 22 and the locking mechanism 26. A central portion 34 encloses the axially driven piston 24. A second end portion 36 encloses the damping system 30.

The first end portion 32 has a threaded section 38 to which the initiator 22 is secured, a gas chamber 40 adjoining the threaded section, a gas conduit portion 42 with conduits 44 extending therethrough to the central portion 34 to bring the initiator gases to bear upon the piston 24 and the locking mechanism 26. The central portion 34 has a series of axial splines 46 to prevent the piston from rotating throughout its stroke as will be discussed infra. The second end portion 36 is roughly cylindrical to enclose the damping system 30. The end 48 of the housing contiguous to the second end portion 36 is enclosed by a disk shaped plug 50 having a hole 52 through its center to provide an opening to check the mechanical condition of the hinge 16, as will be discussed infra.

Figure 4:
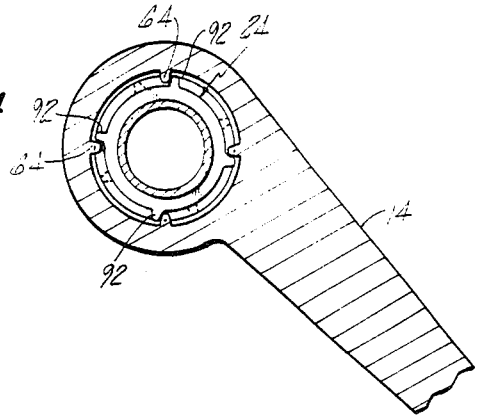
FIG. 4 is a cross-sectional view of the piston of the deployment device of FIG. 3 in contact with a missile fin.

The exterior of the housing has an extension 54 normal to its axis 56 for connection of the housing to the fairing 12. For the purpose of connecting the fin 14 to the housing (and to the fairing thereby), the exterior of the housing has three circumferential openings, an opening 58 proximate the central portion 34, an opening 60 located around the first end portion 32 and an opening 62 located around the second end portion 36. The opening 58 receives a protrusion 64 (or protrusions) of the fin that extends within the central portion of the housing to connect with the piston 24 (see FIG. 4). The other openings 60, 62 each seat a journal bearing 66 which connects the fin to the housing while allowing for smooth fin deployment. End caps 68 are disposed at both ends of the housing to provide further protection to the housing interior and to provide a low aerodynamic profile.

THE INITIATOR

The initiator 22 is an electrically actuated pyrotechnical device having a controlled burn rate and magnitude of charge for creating a certain gaseous pressure to power the deployment device. The selected magnitude of charge depends mainly on the efficiency of the deployment system and the size and weight of a fin, however, charges with magnitudes of between $55\times10^6-110\times10^6$ Pa have been found to be acceptable for deploying a typical fin in from 0.10–0.15 seconds. The initiator has a thread 51 on its exterior surface for removably mating with the threaded portion 38 within the first end portion 32 of the housing. The initiator extends within the housing to the beginning of the gas chamber 40. To prevent leakage of the gas pressure, an O-ring 72 is disposed between a radially extending initiator shoulder 74 and the end of the housing 76. A wire 78 is connected to the initiator through the end cap 68 abutting the first end portion 32 to detonate of the initiator upon receiving a signal from a controller (not shown) within the missile 10. The controller sends a signal to each hinge simultaneously, at the appropriate instance, for the simultaneous deployment of the fins of the missile. Each fin, due to the simultaneous and controlled development thereof, is deployed within from eight one-thousandth to ten one-thousandth (0.008–0.010) of a second of the other fins.

THE PISTON

Figure 5:
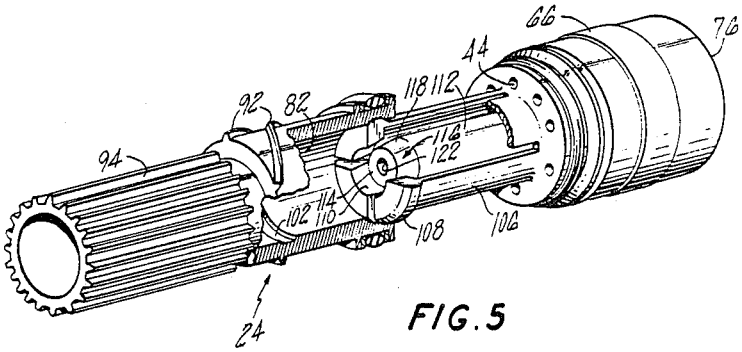
FIG. 5 is a perspective view, partly in section, of the piston and the latching mechanism of FIG. 3.

The generally cylindrical piston 24 is disposed within the central portion 34 of the housing. The piston interior is divided into two discrete sides by a circular web 80 extending normal to the axis 56 of the housing, the web defining a drive side 82 and a driven side 84. The drive side is acted upon by the gases created by the initiator. The driven side engages the hydraulic damping system 30 as will be described infra. Disposed on the outside diameter of each end of the piston, sealing flanges 86, 88 enclose an O-ring 90 that cooperates with the corresponding surface on the interior of the housing to ensure that forces acting on either side of the piston are maintained therein. A helical cam surface 92 (see FIG. 5) is provided on the outside diameter of the drive side 82. The cam surface 92 mates with protrusions 64 provided on the fin (see FIG. 4) to translate the piston axial motion to rotational force to deploy the fin. To ensure that the piston travels in an axial direction without rotation, axial splines 94 are provided on the outside diameter of the driven side of the piston to mate with the axial splines 46 within the housing (see FIG. 5). The stroke of the piston is typically about one and nine-tenths (1.9) centimeters.

Extending from the web along the housing's axis 56, within the driven side of the piston, is a cylindrical plunger 96 tapering from a greater diameter 98 at its attachment point to the web, to a lesser diameter at its cantilevered end 100 (see FIG. 3). The plunger aids the damping system 30 in controlling the rate of piston travel as will be described infra.

Within the interior surface of the drive side 64 are two trapezoidally shaped, spaced, locking grooves 102, 104 cooperate with the locking mechanism 26 which will be described infra. Groove 102, closest to the web 80, defines an inner groove and groove 104 defines an outer groove.

THE LOCKING MECHANISM

Anchored to the gas conduit portion 42 are elongated latching fingers 106. The fingers are circumferentially spaced about the axis 56 of the housing (see FIGS. 3 and 5). The circumferential spacing of the fingers permits them to flex radially upon the application of force and allows the pressurized gas created by the initiator to pass between the fingers to unlock the piston as will be discussed infra. The fingers each have a trapezoidal, radially outwardly extending end portion 108 for fitting in unison within either of the locking grooves 102, 104. The trapezoidal shape of the end portions 108 matches the shape of the grooves to allow the angled end portions 108 to move into and out of the grooves in response to the axial movement of the piston. Each finger has a cam surface 110 located opposite each tapezoidal portion that tapers radially inwardly toward the first end portion 32 and assists in locking the piston as will be described infra.

Disposed for axial movement within the fingers is a hollow second piston 112 having a cap 114 enclosing end 116. An outside portion 118 of the second piston about the end cap tapers radially inwardly toward the end 116 to mate with the cam surface 110 of each latching finger. The outside portion 118 and cam surfaces 110 cooperate to urge the fingers radially outwardly. Disposed within this second piston is a spring 120 abutting the end cap 114. A mechanical access plug 28 (as will be described infra) is set within the chamber 40 to anchor a spring 120. The spring exerts a force upon the second piston to maintain the outside portion 118 in contact with each cam portion of the fingers. The second piston stops the fingers from moving out of the trapezoidal grooves when the outside portion is in contact with cam surface by obstructing any radially inward motion of the fingers. The end cap 114 has a small pressure equalization hole 122 proximate its axial midpoint to allow gas pressure to equalize within and without the second piston as will be described hereinafter.

THE DAMPING SYSTEM

Referring to FIG. 3, the damping system consists of an hydraulic, fluid filled second cylinder 124 fitted in the second end portion 36 of the housing. The damping cylinder has a major bore 126 disposed about the axis 56 of the housing, extending from the driven side of the piston to a point proximate a damping cylinder midpoint. Extending from the major bore along the axis is a minor bore 128 that extends proximate to an end of the damping cylinder. Within the minor bore are two spaced, circumferentially extending channels 130, 132. The innermost channel 130, located further away from the major bore 126 than outermost channel 132, communicates with a flexible bellows 134 through a conduit 136 that passes through the body 138 of the damping cylinder to help decelerate the rate of travel of the piston as will be discussed infra. An annular stop 140 is attached to the end of the minor bore, contiguous to the major bore, to position a cylindrical sleeve 142.

The cylindrical sleeve 142 is disposed for axial movement within the minor bore. The sleeve extends from within the minor bore to the outermost portion of the major bore (see FIG. 3). One end of the sleeve 142, disposed within the minor bore, is closed by a disk shaped washer 146 having a hole 148 in its axial midpoint to smooth the vibrations created as the fin deploys as will be discussed infra. The other end of the sleeve 150, disposed within the major bore, has an opening of reduced diameter 152 which cooperates with the piston plunger 96. The sleeve has a number of circumferentially spaced, radial holes 154 for fluid communication with the outermost channel 132 in the minor bore of the damping cylinder. The sleeve has an annular groove 156 about its outer surface to allow fluid communication between the two circumferential channels 130, 132, the fluid flowing from channel 132 to groove 156 to channel 130. Axial sleeve motion varies the amount of fluid communication between the channels by reducing or increasing the dimension of ports 158 formed between the groove and either channel (see FIG. 3). A spring 160 is disposed within the minor bore between the washer 146 and the body 138 of the damping cylinder. The spring positions the sleeve groove 156 between the channels 130, 132 by pushing the sleeve out of the minor bore until a sleeve shoulder 162 abuts the annular stop 140. With the sleeve so positioned, the ports 158 allow maximum fluid flow therethrough.

The bellows 134 comprising a flexible coupling 162 surrounding a cup-shaped metallic insert 164, serves as a reservoir for fluid escaping from the minor bore through conduit 136. A spring 166 is located between the cup shaped insert 164 and the disk-shaped plug 50 that seals the end of the cylinder. An indicator rod 168 extends from the cup shaped insert through the disk shaped plug hole 52 to indicate the amount of hydraulic fluid within the bellows.

MECHANICAL ACCESS

The mechanical access plug 28 provides the important function of allowing the testing of the fin deployment system as will be discussed infra. The bolt-shaped plug has a head end 170 disposed in the gas chamber 40, a threaded barrel section 172 removeably attaching within a threaded section 173 of the conduit portion 42 and a remote end 174 anchoring the second piston interior spring 120.

OPERATION

During operation, the initiator is fired by the controller, pressurized gas created by the initiator enters the chamber 40 and is brought to bear by the conduits 44 and the spacing between the fingers 106 upon the drive side 82 of the piston and the second piston 112 within the latching fingers. Since the piston 24 is locked against movement because the latching fingers are prevented from flexing radially by contact between the second piston cam surface 118 and the finger cam surface 110, the second piston, within the latching fingers, reacts to the gas pressure. The second piston is driven axially against the force of its interior spring 120, disengaging the cam surfaces 110, 118 and allowing the fingers, driven by the pressure on the piston 24, to move radially inwardly, out the inner groove 102. The unlocked piston 24 is then moved by the gas pressure along the housing axis causing the fin to rotate from its stored position as the piston helical cam surfaces 92 rotate the fin through the connected fin projections 64. As the piston moves through its stroke, the plunger 96 is driven into the sleeve 142 in the hydraulic damping system. As the plunger moves into the sleeve several phenomena take place. Increased fluid pressure caused by the axial motion of the plunger and the driven side piston 84 into the second cylinder 124, drives the sleeve axially into the minor bore causing the port 158 between sleeve indentation 156 and channel 132 to decrease in area allowing less fluid to escape from the bores through the sleeve to the bellows 134 thereby increasing fluid pressure in the second cylinder further. The increased fluid pressure slows the piston. Additionally, since the pin is tapered, the hydraulic fluid pressure within of the sleeve is increased again as the pin moves into the minor bore causing the sleeve to depress further within the minor bore. The further sleeve motion causes the port to narrow further in area, allowing less fluid to escape to the bellows causing increased fluid pressure in the cylinder and causing the piston to slow more quickly. Finally, the spring 166 acting against the bellows causes additional fluid pressure on the piston through conduit 136. The hole 148 in the sleeve washer 146 helps reduce vibration within the cylinder fluid by equalizing fluid pressure within and without the sleeve to provide for smooth deployment of the fin. The net effect of these phenomena is to cause the fin to slow dramatically and smoothly as it reaches its fully deployed position. A typical fin, which may be induced by the initiator to accelerate during deployment at up to one hundred (100) meters/second$^2$, is slowed to less than twenty-five one hundredth (0.25) meters/second at the deployed position. This slowing minimizes the danger of damage to the fin and lock mechanism as the fin nears the deployed position since the high pressure initiator forces are not absorbed mechanically by the lock mechanism, the fin, or a stop mechanism, but by the displacement of fluid in the damping system.

As the piston approaches the end of its stroke, the gas pressure within the second piston 112 is equalizing as the gas moves through the equalization hole 122 in the end cap of the piston. As pressure equalization approaches, the second piston is urged by its interior spring 120 back to its initial position. The piston cam surface 118 engages finger cam surfaces 110 urging the latching fingers into engagement with the outer annular piston groove 104, locking the piston and the fin in its deployed position. With the cam surfaces cooperating, a very strong lock is created as the tapered end of the second piston is essentially solid, obstructing latch finger radially inward motion.

To test the system, a threaded, high pressure, pneumatic device (not shown) replaces the initiator. High pressure air drives the system as would the initiator, thereby testing the system. As a result of the test, the fin is locked in its deployed position. To replace the fin in its stored position, the mechanical access plug 28 is removed allowing the second piston 112 to be withdrawn from contact with the latching fingers. The trapezoidal shapes of the fingers, the shape of the piston groove, applied pressure on the fin urging the piston back to its stored position, and the force of the bellows spring driving fluid against the driven side of the piston, all cooperate to move the fingers out the locking groove. When the piston is driven into its stored position, the second piston is replaced, the tapered portion 118 of which drives the fingers radially outwardly into the inner groove 102. After the replacement of the plug and the initiator, the system is ready for use. The indicator rod 168 provides a quick check of system readiness as any abnormal rod displacement indicates a fluid or other pressure imbalance requiring maintenance.

The system has the following advantages: The electrical firing of the initiator provides substantially simultaneous deployment of all the missile fins; deployment is rapid (under two tenths (0.2) seconds) and controlled (slowing fin speed to below twenty-five one hundredths (0.25) meters per second at the end of the stroke); the entire deployment device is light and compact typically having a diameter of under four (4) centimeters and a length of less than twenty-one (21) centimeters; the locking mechanism is strong, the fingers forming an essentially solid cylinder in conjunction with the second piston, and, the device is easily tested, serviced and maintained.

It should be understood that the invention is not limited to the particular embodiments shown and described herein, but that various changes and modifications may be made without departing from the spirit and scope of the invention as defined by the following claims.

Having thus described the invention, what is claimed:

1. An actuator for the deployment of a fin from a stored to a deployed position characterized by:

a piston connected to said fin for deploying said fin from said stored to said deployed position, a damping means to which said piston is driven to control a rate of travel of said piston, and means for locking said piston and said fin thereby in said stored and in said deployed position, said means comprising first and second circumferential grooves disposed in space relation in a surface of said piston, a plurality of circumferentially spaced regularly flexible finger cooperating with said grooves to lock said piston in said stored and deployed positions, and means for fixing said fingers within said grooves and said stored and deployed positions, said means being responsive to pressure.

2. The actuator of claim 1 further characterized by:

a pyrotechnical means contiguous to said piston for providing a pressured gas to drive said piston along said axis.

3. The actuator of claim 1, further characterized by:

a means disposed on said piston and attaching to said fin for translating piston motion along an axis to rotational force to rotate said fin about said axis.

4. The actuator of claim 3, wherein said means disposed on said piston is characterized by:

a helical cam surface.

5. The actuator of claim 1 further characterized by access means contiguous to said fingers for withdrawing said means for fixing said fingers means from said fingers.

6. The actuator of claim 1, wherein said means for fixing said fingers within said grooves is characterized by:

a second piston disposed within said fingers and cooperating with said fingers to radially urge said fingers to engage said grooves and to move axially out of cooperation with said fingers upon the application of said pressure.

7. The actuator of claim 6 is further characterized as having a spring disposed within said second piston to urge said second piston to cooperate with said fingers.

8. The actuator of claim 7 wherein said second piston is further characterized by having a pressure equalization means to allow for the alleviation of the application of said pressure to allow said spring to urge said second piston to cooperate with said fingers after said pressure has axially moved said second piston out of cooperation with said fingers.

9. An actuator for the deployment of a fin from a stored to a deployed position characterized by:

a piston connected to said fin for deploying said fin from said stored to said deployed position; and a damping means into which said piston is driven to control a rate of travel of said piston, said damping means comprising a fluid filled cylinder for receiving said piston, a fluid reservoir, and variable valving means communicating with said cylinder and said reservoir for slowing a rate of fluid flow therebetween as said piston deploys said fin and is received by said cylinder, said variable valving means characterized by a movable sleeve disposed within and closely cooperating with a bore within said cylinder, said sleeve having a closed end disposed within said bore and an open end extending outside said bore, spaced inner and outer circumferential channels disposed within a surface of said bore contiguous to said sleeve, said inner channel communicating with said reservoir and said outer channel communicating with said cylinder, and circumferential groove within an outer surface of said sleeve contiguous to said bore and arranged between said channels to allow fluid communications between said channels.

10. The actuator of claim 9 further characterized by:

a pyrotechnical means contiguous to said piston for providing a pressured gas to drive said piston along said axis.

11. The actuator of claim 9 further characterized by:

a means disposed on said piston and attaching to said fin for translating piston motion along said axis to rotational force to rotate said fin about said axis.

12. The actuator of claim 11 wherein said means disposed on said piston is characterized by:

a helical cam surface.

13. The actuator of claim 9 further characterized by said sleeve having holes aligning with said outer channel for fluid communication between said outer channel and said cylinder.

14. The actuator of claim 13 further characterized by said sleeve closed end having a hole therethrough for smoothing the motion of said sleeve.

15. The actuator of claim 9 further characterized by: a cantilevered pin attached to said piston for insertion into said sleeve as said cylinder receives said piston.

16. The actuator of claim 15 further characterized by said pin being tapered in diameter inwardly towards its cantilevered end.

17. The actuator of claim 9 further characterized by a second spring means within said bore to urge said sleeve outwardly from said bore.

* * * * *